US011555678B2

(12) United States Patent
Shott et al.

(10) Patent No.: US 11,555,678 B2
(45) Date of Patent: Jan. 17, 2023

(54) SMALL BODY DYNAMICS CONTROL METHOD

(71) Applicant: Raytheon Company, Waltham, MA (US)

(72) Inventors: Craig O. Shott, Tucson, AZ (US); Brayden Peery, Tucson, AZ (US); Gary W. Liles, Tucson, AZ (US); Alex Karwas, Tucson, AZ (US); Gregory J. Larson, Vail, AZ (US)

(73) Assignee: Raytheon Company, Waltham, MA (US)

( * ) Notice: Subject to any disclaimer, the term of this patent is extended or adjusted under 35 U.S.C. 154(b) by 210 days.

(21) Appl. No.: 16/889,003

(22) Filed: Jun. 1, 2020

(65) Prior Publication Data

US 2021/0372753 A1 Dec. 2, 2021

(51) Int. Cl.
*F42B 10/14* (2006.01)

(52) U.S. Cl.
CPC ..... *F42B 10/14* (2013.01)

(58) Field of Classification Search
CPC ..... F42B 10/14; F42B 10/02; F42B 10/64; F42B 15/01
See application file for complete search history.

(56) References Cited

U.S. PATENT DOCUMENTS

| | | | | |
|---|---|---|---|---|
| 2,597,703 | A | 2/1946 | Busacker | |
| 4,145,017 | A * | 3/1979 | Stiklorus | F42B 10/02 244/3.25 |
| 4,944,226 | A | 7/1990 | Wedertz | |
| 5,760,330 | A * | 6/1998 | Himmert | F42B 10/56 102/374 |
| 6,869,044 | B2 | 3/2005 | Geswender et al. | |
| 7,800,032 | B1 | 9/2010 | Facciano et al. | |
| 7,829,829 | B2 * | 11/2010 | King | F42B 10/143 244/3.25 |
| 8,294,072 | B2 | 10/2012 | Geswender et al. | |
| 9,021,961 | B1 | 5/2015 | Manole et al. | |
| 10,852,111 | B1 | 12/2020 | Recchia et al. | |
| 2004/0108412 | A1 | 6/2004 | Moore et al. | |
| 2007/0102568 | A1 | 3/2007 | Higgins et al. | |
| 2008/0006736 | A1 | 1/2008 | Banks | |
| 2009/0045286 | A1 | 2/2009 | King et al. | |
| 2010/0219285 | A1 | 9/2010 | Facciano | |
| 2021/0372752 | A1 | 12/2021 | Shott et al. | |

FOREIGN PATENT DOCUMENTS

| | | |
|---|---|---|
| GB | 1408164 | 11/1972 |
| WO | 2018142402 | 8/2018 |

* cited by examiner

*Primary Examiner* — Benjamin P Lee

(74) *Attorney, Agent, or Firm* — Renner, Otto, Boisselle & Sklar, LLP

(57) ABSTRACT

A projectile including an ejectable aft fin housing assembly. The aft fin housing assembly includes aft fins that increase a distance between a center of gravity and a center of pressure of the projectile, improving passive stabilization of the projectile. Once the projectile has been passively stabilized, the aft fin housing assembly is ejected, decreasing a distance between the center of gravity and the center of pressure, improving active stabilization of the projectile.

20 Claims, 3 Drawing Sheets

10

10

10

SMALL BODY DYNAMICS CONTROL METHOD

GOVERNMENT LICENSE RIGHTS

This invention was made with government support. The government has certain rights in the invention.

TECHNICAL FIELD

The present disclosure relates generally to projectiles and more particularly to stabilization of small form factor aero-bodies.

BACKGROUND

Missiles use active stabilization systems to reduce pitch rate and enable greater control during flight. Small form factor aero-bodies (SFFA) are lower cost, lighter, and smaller compared to traditional missiles. Exemplary SFFA include drones, drone deployables, swarming MAV, precision taggant delivery, precision marking, precision sensor placement, and fireworks. Due to size and cost constraints, the active stabilization systems available to traditional missiles are not possible for SFFA.

SUMMARY

Improved passive deployment stabilization (also referred to as passive stabilization) of small form factor aero-bodies (SFFA) is needed to complement the reduced capabilities of active stabilization available to SFFA (e.g., due to size and cost limitations). Further driving this need is that (compared to traditional missiles) SFFA typically have a high angle of attack, making passive stabilization more difficult.

Passive stabilization of SFFA differs from passive stabilization of traditional missiles. For example, missiles have a length to diameter ratio (LD ratio) of approximately 20 to 1, while SFFA have a LD ratio of approximately 4 to 1. Also, missiles are considerably heavier (e.g., over 9 kg (20 pounds) for missiles as compared to 0.45-2.5 kg (1-5 pounds) for SFFA).

In both missiles and SFFA, stabilization is determined based on the center of pressure (CP) to center of gravity (CG) relationship. Center of pressure is a point where resultant aerodynamic force act on the projectile. Center of gravity is a point where the weight of the body is considered to act. If center of pressure and center of gravity coincide along a length of the projectile, then the net pitching moment produced about the center of gravity due to aerodynamic force is zero.

The above described differences between traditional missiles and SFFA result in different stabilization forces being dominant during passive stabilization. In missiles, passive stabilization is driven by Ma. Conversely, passive stabilization in SFFAs is driven by lateral inertia (Iyy). When launched at a high angle of attack (i.e., an angle of launch relative to a direction of travel at a time of launch), these differences result in traditional missiles having a passive stabilization time of approximately 500 milliseconds (ms) and traditional SFFA having a passive stabilization time of approximately 5 seconds. In one embodiment, a high angle of attack is an angle of 60° or greater. In another embodiment, a high angle of attack is an angle of 75° or greater.

This invention provides a novel, low cost, faster passive stabilization method. This solution is particularly useful with SFFA launched at high angles of attack, where the low cost and small form factor of SFFA drives the need for passive stabilization, because active stabilization may not be cost effective.

The present disclosure provides a projectile including an ejectable aft fin housing assembly that alters a center of pressure (1) to improve passive stabilization of the projectile before ejection and (2) to improve active stabilization of the projectile after ejection.

According to one aspect, there is provided a projectile including a body, and an aft fin housing assembly. The body includes a forward positioned nose. The aft fin housing assembly includes aft fins. The aft fin housing assembly is coupled to the body with a center of pressure of the projectile being aft of a center of gravity of the projectile. The projectile is passively stabilized by the aft fins such that a pitch rate of the projectile is reduced below a capture pitch rate. The aft fin housing assembly is ejectable such that the aft fin housing assembly is no longer mechanically coupled to the body. The center of gravity and the center of pressure of the projectile shifts towards the nose. The nose and the aft fin housing assembling combine for at least 30% of a weight of the projectile and the ejection of the aft fin housing assembly results in a loss of at least 15% of the weight of the projectile.

Alternatively or additionally, the projectile includes a control action system including maneuvering fins and maneuvering motors that alter an orientation of the maneuvering fins. The control action system is configured to actively stabilize the projectile when the pitch rate of the projectile is below the capture pitch rate by altering the orientation of the maneuvering fins when the projectile is in flight in an atmosphere, such that the pitch rate of the projectile is reduced to a stabilized pitch rate.

Alternatively or additionally, a diameter of the maneuvering fins is smaller than a diameter of the aft fins. When the aft fin housing assembly is mechanically coupled to the body, the maneuvering fins are fixed relative to the aft fins, such that the aft fins mechanically stabilize the maneuvering fins.

Alternatively or additionally, the maneuvering fins are mechanically fixed relative to the aft fins when the aft fin housing assembly is mechanically coupled to the body, such that a load caused by the atmosphere on the maneuvering fins is taken by the aft fins.

Alternatively or additionally, a passive capture rate of the projectile comprises a duration of time from launch until the pitch rate of the projectile decreases below the capture pitch rate. When an angle of attack relative to a direction of travel at a time of launch is greater than 60°, the passive capture rate is less than two seconds.

Alternatively or additionally, a length to diameter ratio of the projectile is at most ten-to-one. The length of the projectile is from a forward point of the body to an aft most point of the aft fin housing assembly. A diameter of the projectile is a diameter of the body.

Alternatively or additionally, the projectile has a weight of less than 2.3 kg (five pounds).

Alternatively or additionally, the aft fins are fixed to the aft fin housing assembly during the passive stabilization.

Alternatively or additionally, the projectile is configured to be launched into the atmosphere. Before being launched into the atmosphere, the aft fins are positioned, such that the aft fins have a diameter less than or equal to a diameter of the maneuvering fins. After being launched into the atmosphere, the aft fins are re-oriented such that the aft fins have a diameter greater than the diameter of the maneuvering fins.

Alternatively or additionally, the aft fin housing assembly includes an aft ballast.

Alternatively or additionally, when the aft fin housing assembly is mechanically coupled to body, the center of pressure of the projectile is additionally aft of a center point of a length of the projectile.

Alternatively or additionally, the aft fin housing assembly is ejected when the pitch rate of the projectile is reduced below the capture pitch rate.

Alternatively or additionally, the projectile additionally includes circuitry configured to control ejection of the aft fin housing assembly.

According to another aspect, a method of stabilizing a projectile with an aft fin housing assembly is provided. The method includes measuring a pitch rate of the projectile. The method also compares the pitch rate of the projectile to a capture pitch rate. The method further passively stabilizes the projectile, when the pitch rate is greater than the capture pitch rate, using aft fins of the aft fin housing assembly. The aft fins are configured to cause a center of pressure of the projectile to be aft of both a center point of a length of the projectile and a center of gravity of the projectile. The method additionally ejects the aft fin housing assembly, when a pitch rate of the projectile is less than the capture pitch rate, such that the aft fin housing assembly is no longer mechanically coupled to a body of the projectile, and the center of gravity and the center of pressure of the projectile shifts towards a nose of the projectile. The nose and the aft fin housing assembling combine for at least 30% of a weight of the projectile and the ejection of the aft fin housing assembly results in a loss of at least 15% of the weight of the projectile.

Alternatively or additionally, when the pitch rate of the projectile is less than the capture pitch rate, actively stabilizing the projectile by altering an orientation of maneuvering fins of a control action system using maneuvering motors of the control action system, such that a pitch rate of the projectile is reduced to a stabilized pitch rate.

Alternatively or additionally, when the pitch rate of the projectile is greater than the capture pitch rate, the maneuvering fins of the control action system are stabilized by fixing a position of maneuvering fins of relative to the aft fins.

Alternatively or additionally, the maneuvering fins are mechanically fixed relative to the aft fins when the aft fin housing assembly is mechanically coupled to the body, such that an aerodynamic load on the maneuvering fins is transferred to the aft fins.

Alternatively or additionally, the passive stabilization of the projectile is performed in less than two seconds from a launch of the projectile into an atmosphere until a pitch rate of the projectile decreases below the capture rate.

Alternatively or additionally, the aft fins are fixed to the aft fin housing assembly during the passive stabilization.

Alternatively or additionally, prior to passively stabilizing the projectile: launching the projectile into an atmosphere with the aft fins positioned such that the aft fins have a diameter less than or equal to a diameter of the maneuvering fins; and after being launched into the atmosphere, reorienting the aft fins, such that the aft fins have a diameter greater than the diameter of the body.

While a number of features are described herein with respect to embodiments of the invention; features described with respect to a given embodiment also may be employed in connection with other embodiments. The following description and the annexed drawings set forth certain illustrative embodiments of the invention. These embodiments are indicative, however, of but a few of the various ways in which the principles of the invention may be employed. Other objects, advantages and novel features according to aspects of the invention will become apparent from the following detailed description when considered in conjunction with the drawings.

BRIEF DESCRIPTION OF THE DRAWINGS

The annexed drawings, which are not necessarily to scale, show various aspects of the invention in which similar reference numerals are used to indicate the same or similar parts in the various views.

Figure 3:
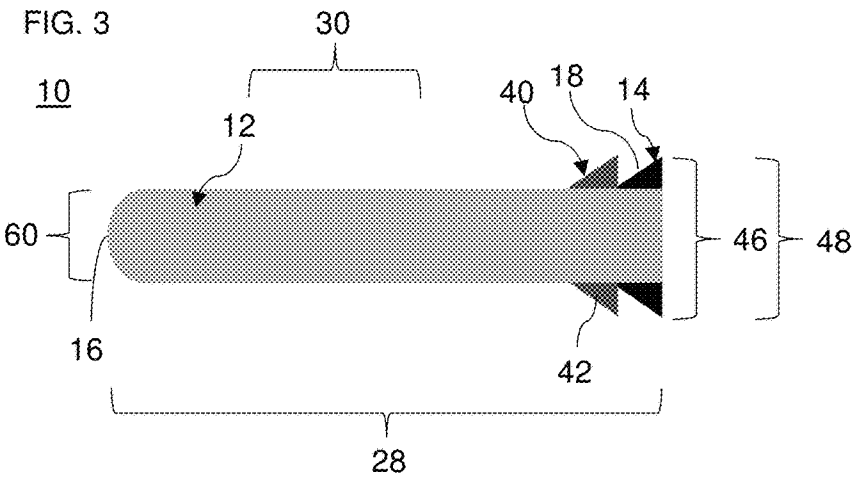
FIG. 3 shows the projectile of FIG. 1 before deployment of aft fins.

The present invention is now described in detail with reference to the drawings. In the drawings, each element with a reference number is similar to other elements with the same reference number independent of any letter designation following the reference number. In the text, a reference number with a specific letter designation following the reference number refers to the specific element with the number and letter designation and a reference number without a specific letter designation refers to all elements with the same reference number independent of any letter designation following the reference number in the drawings.

DETAILED DESCRIPTION

A projectile includes an ejectable aft fin housing assembly. The aft fin housing assembly includes aft fins that increase a distance between a center of gravity and a center of pressure of the projectile, improving passive stabilization of the projectile. Once the projectile has been passively stabilized, the aft fin housing assembly is ejected, shifting the center of gravity and the center of pressure towards the nose, improving active stabilization of the projectile.

Figure 1:
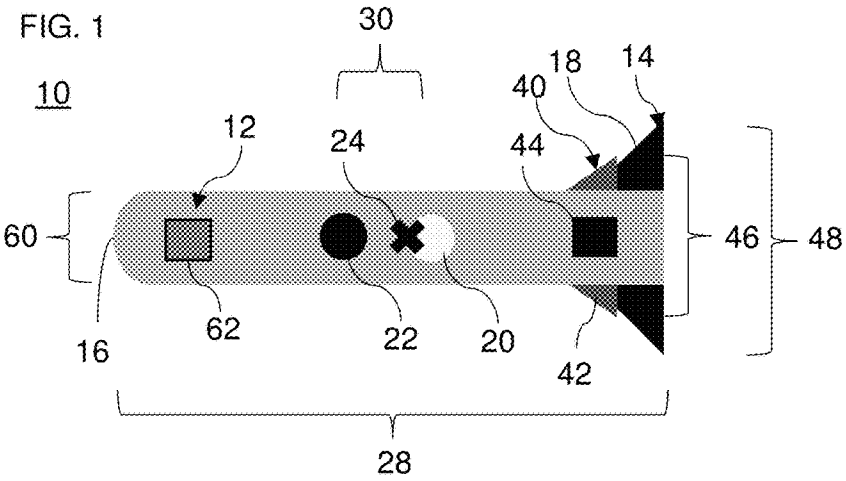
FIG. 1 shows a schematic diagram of a projectile including an aft fin housing assembly.

Turning to FIG. 1, a projectile 10 including a body 12 and an aft fin housing assembly 14 is shown. The body 12 includes a forward positioned nose 16 and the aft fin housing assembly 14 includes aft fins 18. The aft fin housing assembly 14 is mechanically coupled to the body 12. In an embodiment, the body 12 and the aft fin housing assembly 14 are configured such that the center of gravity 22 is located closer to a center point 24 of a length 28 of the projectile than to the nose 16.

In an embodiment, the body 12 includes a skin, an airframe, and a forward ballast (also referred to as a nose ballast). The airframe is located inside of the skin and the skin protects internal components of the projectile 10 from an atmosphere (e.g., a liquid or gas) that the projectile 10 is passing through. A weight and position of the forward ballast is chosen based on a desired location of a center of gravity (CG) 22 of the projectile 10. (As is described in further detail below, the position of the center of gravity affects stabilization of the projectile.) In an embodiment, the ballast is positioned adjacent a nose 16 of the projectile 10.

In another embodiment, the body 12 does not include a forward ballast, but instead a composition of the skin, airframe, and other components of the projectile is chosen based on the desired location of the center of gravity 22. For example, the nose 16 may include shielding and/or a portion of the airframe nearer the nose 16 may be made of a heavier material than a different portion of the airframe nearer the aft of the projectile 10.

In an embodiment, a length 28 to diameter 60 ratio (LD ratio) of the projectile is at most five-to-one. In another embodiment, the LD ratio is at most 10-to-one. In still another embodiment, the LD ratio is between 4-to-1 and 8-to-1. The length 28 of the projectile 10 is from a forward point of the body to an aft most point of the aft fin housing assembly 14. A diameter 60 of the projectile 10 is the diameter of the body 12 of the projectile.

In the embodiment depicted in FIG. 1, the length 28 of the projectile is not affected by ejection of the aft fin housing assembly 14. In this embodiment, the aft fin housing assembly 14 may be a torus that fits around the body 12. Alternatively, in another embodiment, the length 28 of the projectile is affected by ejection of the aft fin housing assembly 14. In this embodiment, the aft fin housing assembly 14 may be placed in line with the body 12, such that the length 28 of the projectile is reduced by ejection of the aft fin housing assembly 14.

In an embodiment, the projectile 10 has a weight of less than 2.3 kg (five pounds). In another embodiment, the projectile has a weight of less than 4.6 kg (ten pounds).

Figure 2:
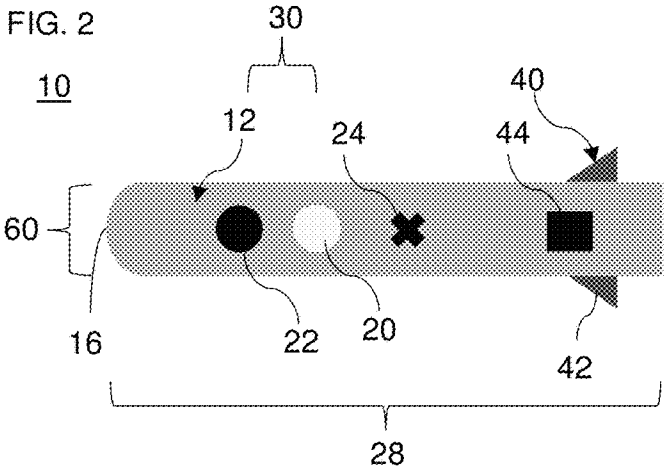
FIG. 2 shows the projectile of FIG. 1 without the aft fin housing assembly.

As described above, the aft fin housing assembly 14 includes aft fins 18. The aft fins 18 affect a center of pressure (CP) 20 of the projectile 10. As shown in FIG. 2, the aft fin housing assembly 14 is also ejectable, such that the aft fin housing assembly 14 is no longer mechanically coupled to the body 12 after being ejected. The nose 16 and the aft fin housing assembling 14 have a combined mass that is a large percentage of the projectile weight. The ejection of the aft fin housing assembly 14 results in a mass loss of the projectile. By ejecting the aft fin housing assembly 14, the center of pressure 20 of the projectile 10 is altered by removal of the aft fins 18. In an embodiment, the projectile 10 additionally includes circuitry 62 that controls ejection of the aft fin housing assembly 14. In another embodiment, a deterministic charge is used to separate the aft fin housing assembly 14 from the body 12.

In one embodiment, the combined mass of the nose 16 and the aft fin housing assembly 14 is at least 30% of the projectile weight. In another embodiment, the combined mass of the nose 16 and the aft fin housing assembly 14 is at least 40% of the projectile weight. In one embodiment, the mass of the aft fin housing assembly 14 is at least 15% of the projectile weight. In another embodiment, the mass of the aft fin housing assembly 14 is at least 20% of the projectile weight.

In the embodiment shown in FIGS. 1 and 2, the projectile 10 is shown along with the relative positions of the center of pressure 20 and the center of gravity 22. In FIG. 1, the presence of the aft fins 18 affects the center of pressure 20, such that the center of pressure is located aft of the center point 24 along the length 28 of the projectile 10. The presence of the aft fin housing assembly 14 also affects the center of gravity 22. In FIG. 2, the aft fin housing assembly 14 has been ejected so that it is no longer mechanically coupled to the body 12. Due to the lack of the aft fins 18 and the loss of the mass of the aft fin housing assembly 14, ejecting the aft fin housing assembly 14 shifts the center of pressure 20 and the center of gravity 22 of the projectile 10 towards the nose 16. Ejecting the aft fin housing assembly 14 may decrease a distance 30 between the center of gravity 22 and the center of pressure 20. Alternatively, ejecting the aft fin housing assembly 14 may increase the distance 30 between the center of gravity 22 and the center of pressure 20 or may have no effect on the distance 30.

Properties of the aft fins 18 (e.g., material, size, position, etc.) are chosen, such that a position of the center of pressure 20 is located at a preferred location when the aft fin housing assembly 14 is mechanically coupled to the body 12. In particular, when the aft fin housing assembly 14 is mechanically coupled to body 12, the center of pressure 20 of the projectile 10 is aft of a center of gravity 22 of the projectile. In the embodiment shown in FIG. 1, the center of pressure 20 of the projectile is additionally aft of a center point 24 of a length 28 of the projectile.

Properties of the aft fin housing assembly 14 (e.g., materials, size, position, etc.) are chosen such that the center of gravity 22 is both located at a first desired location before ejection of the aft fin housing assembly 14 and is located at a second desired location after ejection of the aft fin housing assembly 14. For reasons described in further detail below, in one embodiment, the aft fin housing assembly 14 includes an aft ballast for increasing a weight of the aft fin housing assembly 14. In another embodiment, the aft fins 18 are made of a heavier material (e.g., tungsten as opposed to nylon) to increase a weight of the aft fin housing assembly.

In an embodiment, the aft fin housing assembly 14 includes a fixation structure for maintaining a position of the aft fins 18 relative to the body 12. In one embodiment, the fixation structure is an extension of the body 12, such that the length 28 of the projectile 10 decreases when the aft fin housing assembly 14 is ejected. The aft fins 18 are mechanically attached to the fixation structure such that ejecting the fixation structure also ejects the aft fins 18.

When the aft fin housing assembly 14 is mechanically coupled to the body 12, the projectile 10 is passively stabilized by the aft fins 18, such that a pitch rate of the projectile 10 is reduced below a capture pitch rate (a stabilized pitch rate).

In an embodiment, the projectile 10 also includes a control action system 40. The control action system 40 includes maneuvering fins 42, and maneuvering motors 44 that alter an orientation of the maneuvering fins 42. When the pitch rate of the projectile 10 is below the capture pitch rate, the control action system 40 actively stabilizes the projectile 10 by altering the orientation of the maneuvering fins 42, such that the pitch rate of the projectile 10 is reduced to a stabilized pitch rate. In this embodiment, the capture pitch rate is determined based upon capabilities of the control action system 40. That is, the capture pitch rate is determined as a pitch rate that the control action system 40 is capable of actively stabilizing to the stabilized pitch rate. Similarly, the stabilized pitch rate may be determined based on capabilities of a guidance system of the projectile 10. In an embodiment, the stabilized pitch rate is determined based on a maximum pitch rate that the guidance system can actively guide the projectile 10 to a defined location when the projectile is experiencing the maximum pitch rate. The maximum pitch rate may be a pitch rate of approximately 0 degrees per second.

Returning to FIG. 1, the center of pressure 20 is located aft of center of gravity 22 and at a distance 30 from the center of gravity 22 to provide for nose-forward flight. When the aft fin housing assembly 14 is mechanically coupled to the body 12 (FIG. 1), an increased distance 30 between the center of pressure 20 and the center of gravity 22 enables faster passive stabilization of the projectile 10. When the aft fin housing assembly 14 is ejected (FIG. 2), the distance 30 between the center of pressure 20 and the center of gravity 22 may decrease. A decreased distance 30 may enable the control action system 40 to use smaller maneuvering fins 42 and less powerful and less expensive maneuvering motors 44 to stabilize flight of the projectile 10 (i.e., reduce the pitch rate to enable guided flight). Consequently, the projectile 10 has improved passive stabilization when the aft fin housing assembly 14 is mechanically coupled to the body 12, followed by improved active control when the aft fin housing assembly 14 has been ejected.

In one embodiment, the aft fin housing assembly 14 is ejected when the pitch rate of the projectile 10 is reduced below the capture pitch rate. As described above, ejecting the aft fin housing assembly shifts center of gravity 22 and center of pressure 20 forward toward the nose 16, enabling the maneuvering fins 42 to actively stabilize the projectile 10.

Including the ejectable aft fin housing assembly 14 improves passive stabilization of the projectile 10 (also referred to as a passive capture rate). The stabilized pitch rate time of the projectile 10 is a duration of time from launch of the projectile 10 until the pitch rate of the projectile 10 decreases below the capture pitch rate (stabilized pitch rate). In one embodiment, when an angle of attack relative to a direction of travel at a time of launch is greater than 60°, the stabilized pitch rate time of the projectile is less than two seconds.

Increased distance 30 between center of gravity 22 and center of pressure 20 does not improve stabilization time of the projectile 10 as would be expected for typical missiles due to differences in weight and LD ratio as described above. That is, while the aft fins 18 improved passive stabilization time (i.e., the time from launch that it takes to reduce the pitch rate to below the capture pitch rate) from 5 seconds without fins to 3 seconds with the fins, stabilization time did not reduce to approximately 1 second as was expected. The reason that passive stabilization did not improve as much as expected is because ma is not the dominant driver of passive stabilization in SFFA as it is for missiles. Instead, inertial dampening is the dominant driver of passive stabilization of SFFA. For this reason, a weight of the aft fin housing assembly 14 was increased to improve stabilization as described below.

Figure 4:
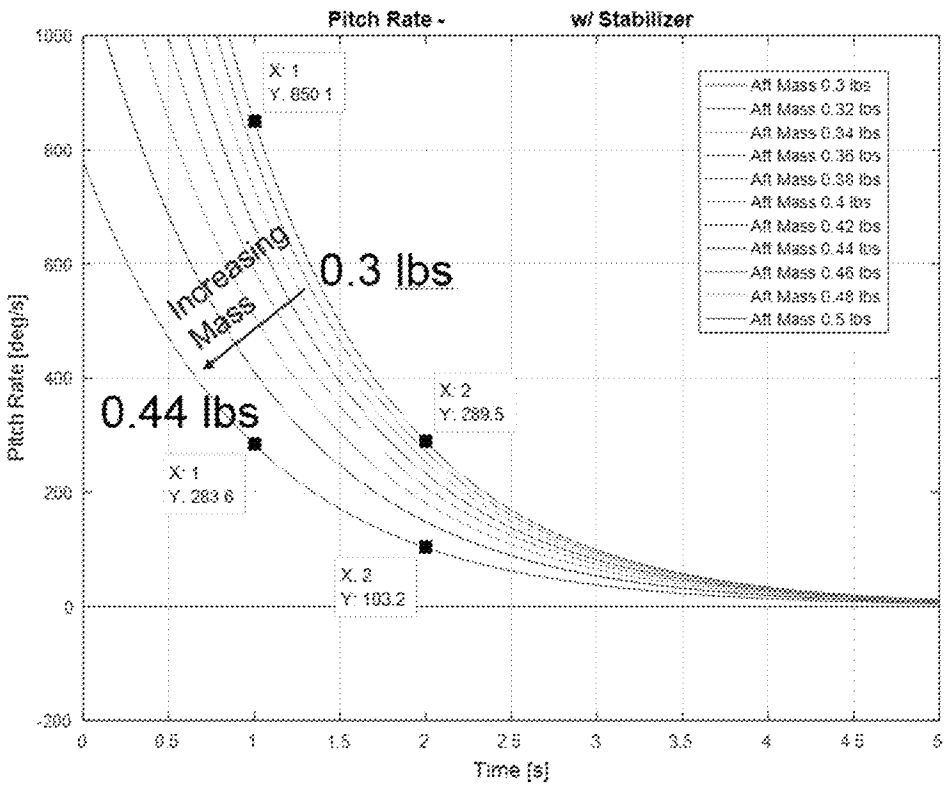
FIG. 4 shows a plot of pitch rate and time for projectiles having different weights.

Turning to FIG. 4, a plot showing the relationship between pitch rate, time, and weight of the aft fin housing assembly 14 is shown. Assuming that the control action system 40 has a capture rate of 250 degrees/second, a projectile 10 having an aft fin housing assembly 14 weighing 0.44 pounds reaches the capture rate in approximately 1 second, while a projectile 10 having an aft fin housing assembly 14 weighing 0.3 pounds reaches the capture rate after being launched into the atmosphere in approximately 2 seconds. The reason for the improved capture rate at higher weights is that the weight of the aft fin housing assembly 14 improves inertial dampening. If weight is only added to the nose 16 of the body 12, such that there is a larger distance between the center of pressure 20 and the center of gravity 22, the relatively low lateral inertial of the projectile is insufficient to dampen out the oscillations created during launch at high angles of attack, increasing the passive stabilization timeline. Consequently, the projectile 10 is constructed such that a weight of the nose 16 and a weight of the aft fin housing assembly 14 result in a decreased distance 30 between the center of pressure 20 and the center of gravity 22.

The increased weight in the aft section of the projectile 10 is included with the aft fin housing assembly 14 so that, when the aft fin housing assembly 14 is ejected, the weight of the aft section of the projectile 10 is reduced. This decreased overall weight of the projectile 10 allows the control action system 14 to more easily stabilize the projectile.

In the embodiment shown in FIG. 1, a diameter 46 of the maneuvering fins 42 is smaller than a diameter 48 of the aft fins 18. When the aft fin housing 14 assembly is mechanically coupled to the body 12, the maneuvering fins 42 are fixed relative to the aft fins 18, such that the aft fins 18 mechanically stabilize the maneuvering fins 42. In an embodiment, the aft fins 18 are fixed to the aft fin housing assembly 14 during passive stabilization (i.e., while the aft fin housing assembly 14 is mechanically coupled to the body 12).

In one embodiment, the maneuvering fins 42 are supported by the aft fin housing assembly 14. In an embodiment, the maneuvering fins 42 are mechanically fixed relative to the aft fins 18 when the aft fin housing assembly 14 is mechanically coupled to the body 12, such that a load caused by the fluid (e.g., the atmosphere that the projectile is passing through) on the maneuvering fins 42 is taken by the aft fins 18. In one embodiment, the aft fins 18 include a notch that mechanically couples the maneuvering fins 42 and the aft fins 18. In this way, the maneuvering fins may be shielded from mechanical loads at higher pitch rates that could, e.g., cause damage to the maneuvering fins and/or maneuvering motors.

In the embodiment shown in FIG. 3, before being launched into the atmosphere, the aft fins 18 are positioned, such that the aft fins 18 have a diameter less than or equal to a diameter of the maneuvering fins 42. After being launched into the atmosphere, the aft fins 18 are re-oriented such that the aft fins 18 have a diameter 48 greater than the diameter of the maneuvering fins 46. In this embodiment, the increased diameter of the aft fins 18 post deployment pulls the center of pressure 20 aft.

In an embodiment, multiple projectiles 10 may be placed in a launching platform. The projectiles 10 may be ejected at odd angles (e.g., having a high angle of attack compared with typical missiles) from the launching platform due to the projectiles 10 being placed into the ejection platform at positions and angles designed to maximize the number of projectiles that can be fit into the launching platform. (Angle of attack refers to the angle between a central axis of the projectile along its length and a direction of travel of the projectile.) When ejected with a high angle of attack, passive stabilization is important to ensure that the pitch rate is reduced below the capture pitch rate of the control action system 40 to enable delivery of the projectile 10 to an identified location.

In an embodiment, the projectile 10 includes guidance for controlling a flight path of the projectile 10 to ensure that the projectile 10 is delivered to a determined identified location. In an embodiment, the guidance is part of the circuitry 62.

The circuitry 62 may have various implementations. For example, the circuitry 62 may include any suitable device, such as a processor (e.g., CPU), programmable circuit, integrated circuit, memory and I/O circuits, an application specific integrated circuit, microcontroller, complex programmable logic device, other programmable circuits, or the like. The circuitry 62 may also include a non-transitory computer readable medium, such as random access memory (RAM), a read-only memory (ROM), an erasable programmable read-only memory (EPROM or Flash memory), or any other suitable medium. Instructions for performing the method described below may be stored in the non-transitory computer readable medium and executed by the circuitry 62. The circuitry 62 may be communicatively coupled to the computer readable medium through a system bus, mother board, or using any other suitable structure known in the art.

While the projectile is shown in the figures having a shape similar to a missile, the projectile 10 is not limited to being a missile. For example, the projectile 10 may be a drone, drone deployable, swarming MAV, precision taggant delivery, precision marking, precision sensor placement, missile, firework, unmanned aerial vehicle (UAV), etc.

Figure 5:
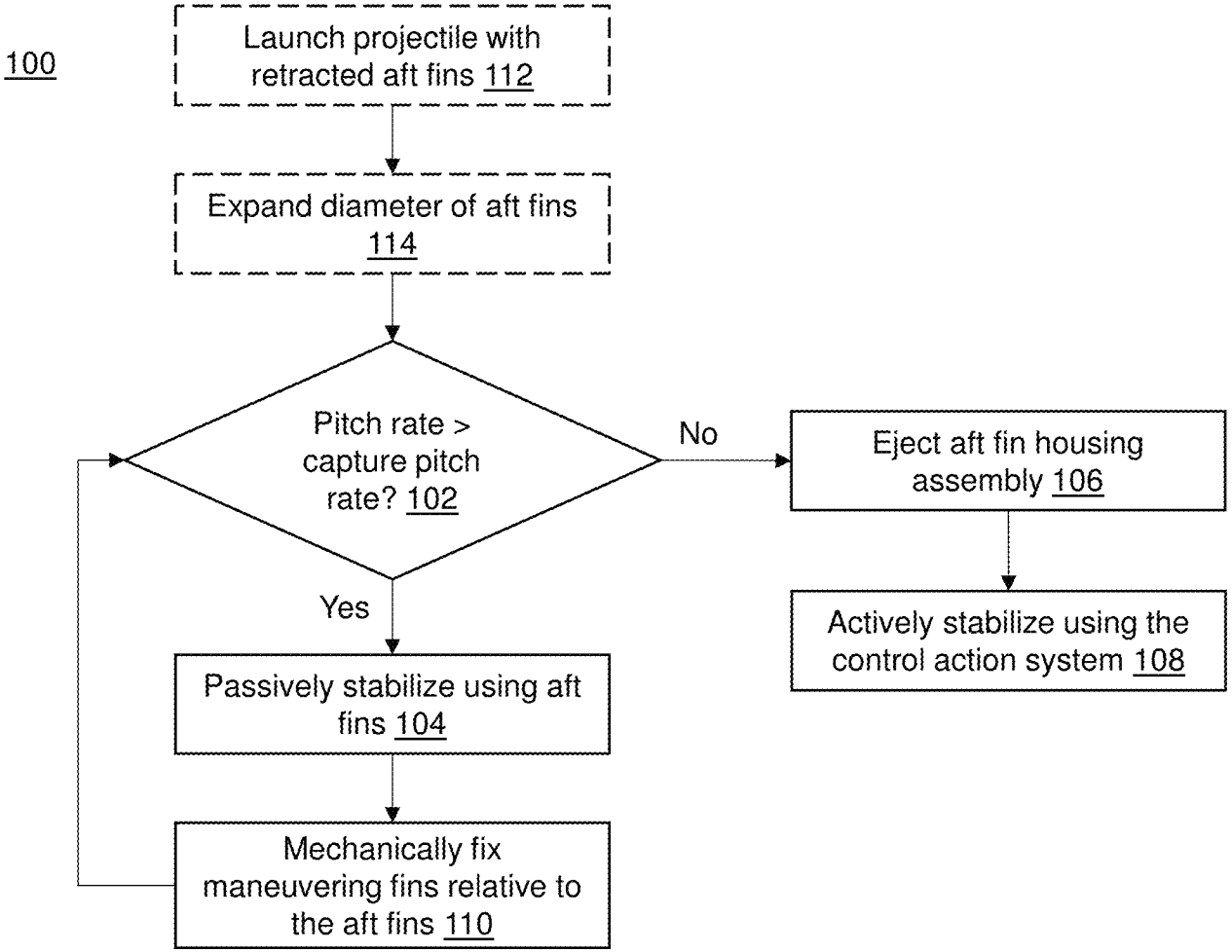
FIG. 5 is a flowchart depicting a method for stabilizing flight of the projectile of FIG. 1.

Turning to FIG. 5, a method 100 for stabilizing a projectile in flight in an atmosphere is shown. In decision block 102, a pitch rate of the projectile 10 is compared to the capture pitch rate. If the pitch rate is greater than the capture pitch rate, then the method progresses to process block 104. If the pitch rate is less than or equal to the capture pitch rate, then the method progresses to process block 106.

In process block 104, the projectile is passively stabilized using aft fins 18 of the aft fin housing assembly 14. As described above, the aft fins 18 are configured to cause a center of pressure 20 of the projectile 10 to be aft of both the center point 24 of the length 28 of the projectile and the center of gravity 22 of the projectile.

In process block 106, the aft fin housing assembly 14 is ejected, such that the aft fin housing assembly is no longer mechanically coupled to the body. Ejecting the aft fin housing assembly 14 causes the center of gravity 22 and the center of pressure 20 of the projectile to shift towards the nose 16 of the projectile. Ejecting the aft fin housing assembly 14 may also cause a distance 30 between the center of gravity 22 and the center of pressure 20 to decrease. Alternatively, ejecting the aft fin housing assembly 14 may increase the distance 30 between the center of gravity 22 and the center of pressure 20 or may have no effect on the distance 30.

In an embodiment, the method moves from process block 106 to process block 108. In process block 108, the control action system 40 actively stabilizes the projectile 10 by altering an orientation of maneuvering fins 42 the using maneuvering motors 44, such that a pitch rate of the projectile is reduced to a stabilized pitch rate.

In an embodiment, when the pitch rate of the projectile is greater than the capture pitch rate, processing moves from process block 104 to process block 110. In process block 110, the maneuvering motors 44 of the control action system 40 are stabilized by fixing a position of maneuvering fins 42 of the control action system 40 relative to the aft fins 18.

In one embodiment of process block 110, the maneuvering fins 42 are mechanically fixed relative to the aft fins 18 when the aft fin housing assembly 14 is mechanically coupled to the body 12, such that a load caused by the atmosphere on the maneuvering fins 42 is taken by the aft fins 18.

In an embodiment, the passive stabilization of the projectile 10 is performed in less than 1.5 seconds from a launch of the projectile into the atmosphere until a pitch rate of the projectile decreases below the capture rate.

In an embodiment, the method 100 may include process block 112 before decision block 102. In process block 112, the projectile 10 is launched into an atmosphere with the aft fins 18 positioned such that the aft fins 18 have a diameter 48 less than or equal to a diameter 46 of the maneuvering fins 42. After being launched into the atmosphere in process block 112, the aft fins 18 are re-oriented in process block 114, such that the aft fins 18 have a diameter 48 greater than the diameter 46 of the maneuvering fins 44.

Throughout this disclosure, when referring to both passive and active stabilization of the projectile, the projectile is assumed to be moving (e.g., in flight, falling, etc.) in an atmosphere.

All ranges and ratio limits disclosed in the specification and claims may be combined in any manner. Unless specifically stated otherwise, references to "a," "an," and/or "the" may include one or more than one, and that reference to an item in the singular may also include the item in the plural.

Although the invention has been shown and described with respect to a certain embodiment or embodiments, equivalent alterations and modifications will occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein illustrated exemplary embodiment or embodiments of the invention. In addition, while a particular feature of the invention may have been described above with respect to only one or more of several illustrated embodiments, such feature may be combined with one or more other features of the other embodiments, as may be desired and advantageous for any given or particular application.

The invention claimed is:

1. A projectile comprising:

a body including a forward positioned nose; and an aft fin housing assembly including aft fins, the aft fin housing assembly coupled to the body with a center of pressure of the projectile being aft of a center of gravity of the projectile, and the projectile being passively stabilized by the aft fins such that a pitch rate of the projectile is reduced below a stabilized pitch rate;

wherein the aft fin housing assembly is ejectable such that the aft fin housing assembly is no longer mechanically coupled to the body, and the center of gravity and the center of pressure of the projectile shifts towards the nose;

wherein the nose and the aft fin housing assembling combine for at least 30% of a weight of the projectile and the ejection of the aft fin housing assembly results in a loss of at least 15% of the weight of the projectile;

wherein the aft fins are fixed to the aft fin housing assembly while the aft fin housing assembly is mechanically coupled to the body; and wherein the aft fins deploy radially and maintain a deployed position once radially deployed.

2. The projectile of claim 1, further comprising a control action system including maneuvering fins and maneuvering motors that alter an orientation of the maneuvering fins, wherein the control action system is configured to actively stabilize the projectile when the pitch rate of the projectile is below the stabilized pitch rate by altering the orientation of the maneuvering fins when the projectile is in flight in an atmosphere.

3. The projectile of claim 1, wherein:

a stabilized pitch rate time of the projectile comprises a duration of time from launch until the pitch rate of the projectile decreases below the stabilized pitch rate; and when an angle of attack relative to a direction of travel at a time of launch is greater than 60°, the stabilized pitch rate time is less than two seconds.

4. The projectile of claim 1, wherein:

a length to diameter ratio of the projectile is at most ten-to-one;

the length of the projectile is from a forward point of the body to an aft most point of the aft fin housing assembly; and a diameter of the projectile is a diameter of the body.

5. The projectile of claim 1, wherein the projectile has a weight of less than 2.3 kg (five pounds).

6. The projectile of claim 1, wherein the aft fins are fixed to the aft fin housing assembly during the passive stabilization.

7. The projectile of claim 1, wherein:

the projectile is configured to be launched into the atmosphere;

before being launched into the atmosphere, the aft fins are positioned, such that the aft fins have a diameter less than or equal to a diameter of the maneuvering fins; and after being launched into the atmosphere, the aft fins are re-oriented such that the aft fins have a diameter greater than the diameter of the maneuvering fins.

8. The projectile of claim 1, wherein the aft fin housing assembly includes an aft ballast.

9. The projectile of claim 1, wherein when the aft fin housing assembly is mechanically coupled to body, the center of pressure of the projectile is additionally aft of a center point of a length of the projectile.

10. The projectile of claim 1, wherein the aft fin housing assembly is ejected when the pitch rate of the projectile is reduced below the stabilized pitch rate.

11. The projectile of claim 1, further comprising circuitry configured to control ejection of the aft fin housing assembly.

12. A method of stabilizing a projectile with an aft fin housing assembly comprising:

measuring a pitch rate of the projectile;

comparing the pitch rate of the projectile to a stabilized pitch rate;

passively stabilizing the projectile, when the pitch rate is greater than the stabilized pitch rate, using aft fins of the aft fin housing assembly, wherein the aft fins are configured to cause a center of pressure of the projectile to be aft of both a center point of a length of the projectile and a center of gravity of the projectile;

ejecting the aft fin housing assembly, when a pitch rate of the projectile is less than the stabilized pitch rate, such that the aft fin housing assembly is no longer mechanically coupled to a body of the projectile, and the center of gravity and the center of pressure of the projectile shifts towards a nose of the projectile;

wherein the nose and the aft fin housing assembling combine for at least 30% of a weight of the projectile and the ejection of the aft fin housing assembly results in a loss of at least 15% of the weight of the projectile.

13. The method of claim 12, further comprising, when the pitch rate of the projectile is less than the stabilized pitch rate, actively stabilizing the projectile by altering an orientation of maneuvering fins of a control action system using maneuvering motors of the control action system.

14. The method of claim 13, further comprising when the pitch rate of the projectile is greater than the stabilized pitch rate, the maneuvering fins of the control action system are stabilized by fixing a position of maneuvering fins of relative to the aft fins.

15. The method of claim 14, wherein the maneuvering fins are mechanically fixed relative to the aft fins when the aft fin housing assembly is mechanically coupled to the body, such that an aerodynamic load on the maneuvering fins is transferred to the aft fins.

16. The method of claim 12, wherein the passive stabilization of the projectile is performed in less than two seconds from a launch of the projectile into an atmosphere until a pitch rate of the projectile decreases below the stabilized pitch rate.

17. The method of claim 12, wherein the aft fins are fixed to the aft fin housing assembly during the passive stabilization.

18. The method of claim 12, further comprising, prior to passively stabilizing the projectile:

launching the projectile into an atmosphere with the aft fins positioned such that the aft fins have a diameter less than or equal to a diameter of the maneuvering fins; and after being launched into the atmosphere, re-orienting the aft fins, such that the aft fins have a diameter greater than the diameter of the body.

19. A projectile comprising:

a body including a forward positioned nose; and an aft fin housing assembly including aft fins, the aft fin housing assembly coupled to the body with a center of pressure of the projectile being aft of a center of gravity of the projectile, and the projectile being passively stabilized by the aft fins such that a pitch rate of the projectile is reduced below a stabilized pitch rate;

wherein the aft fin housing assembly is ejectable such that the aft fin housing assembly is no longer mechanically coupled to the body, and the center of gravity and the center of pressure of the projectile shifts towards the nose;

a control action system including maneuvering fins and maneuvering motors that alter an orientation of the maneuvering fins;

wherein the nose and the aft fin housing assembling combine for at least 30% of a weight of the projectile and the ejection of the aft fin housing assembly results in a loss of at least 15% of the weight of the projectile;

wherein the control action system is configured to actively stabilize the projectile when the pitch rate of the projectile is below the stabilized pitch rate by altering the orientation of the maneuvering fins when the projectile is in flight in an atmosphere;

wherein a diameter of the maneuvering fins is smaller than a diameter of the aft fins; and wherein when the aft fin housing assembly is mechanically coupled to the body, the maneuvering fins are fixed relative to the aft fins, such that the aft fins mechanically stabilize the maneuvering fins.

20. The projectile of claim 19, wherein the maneuvering fins are mechanically fixed relative to the aft fins when the aft fin housing assembly is mechanically coupled to the body, such that a load caused by the atmosphere on the maneuvering fins is taken by the aft fins.

* * * * *